US009540913B2

(12) United States Patent
Moore

(10) Patent No.: US 9,540,913 B2
(45) Date of Patent: Jan. 10, 2017

(54) METHOD AND APPARATUS FOR ACTUATING A DIFFERENTIAL PRESSURE FIRING HEAD

(75) Inventor: Randall S. Moore, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 719 days.

(21) Appl. No.: 13/817,038

(22) PCT Filed: Apr. 11, 2012

(86) PCT No.: PCT/US2012/032966

§ 371 (c)(1),
(2), (4) Date: Feb. 14, 2013

(87) PCT Pub. No.: WO2013/154544

PCT Pub. Date: Oct. 17, 2013

(65) Prior Publication Data

US 2014/0008069 A1 Jan. 9, 2014

(51) Int. Cl.
*E21B 43/1185* (2006.01)

(52) U.S. Cl.
CPC ..... *E21B 43/11852* (2013.01)

(58) Field of Classification Search
CPC ..... E21B 43/11852; E21B 43/11
See application file for complete search history.

(56) References Cited

U.S. PATENT DOCUMENTS 4,566,544 A 1/1986 Bagley et al.
4,616,718 A 10/1986 Gambertoglio
4,917,189 A * 4/1990 George et al. ..... 166/297
4,969,525 A 11/1990 George et al.
5,161,616 A 11/1992 Colla
5,297,629 A 3/1994 Barrington et al.
5,301,755 A 4/1994 George et al.
5,490,563 A * 2/1996 Wesson ..... E21B 43/1185 166/297
6,035,880 A * 3/2000 Gazda ..... E21B 21/103 137/68.16
2011/0088946 A1 4/2011 Moore et al.

OTHER PUBLICATIONS

Written Opinion for PCT/US2012/032966 dated Feb. 27, 2013.
International Search Report for PCT/US2012/032966 dated Feb. 27, 2013.

* cited by examiner

*Primary Examiner* — Elizabeth Gitlin
(74) *Attorney, Agent, or Firm* — Chamberlain Hrdlicka

(57) ABSTRACT

A method and apparatus are presented for actuating a differential pressure firing head to actuate a perforating gun at a downhole location in a subterranean wellbore adjacent a formation. An exemplary method includes positioning the perforating gun and the differential pressure firing head at a downhole location on a tubing string and then communicating an applied fluid pressure to a wellbore annulus, a first chamber which communicates the applied fluid pressure to a low-pressure side of the firing head assembly, and a second fluid chamber which communicates the applied fluid pressure to a high-pressure side of the firing head assembly. The applied fluid pressure is then trapped within the second fluid chamber. When the applied pressure in the annulus is subsequently removed, a pressure differential is created across the firing head by the low pressure in the first chamber and the trapped applied pressure in the second chamber.

20 Claims, 5 Drawing Sheets

METHOD AND APPARATUS FOR ACTUATING A DIFFERENTIAL PRESSURE FIRING HEAD

CROSS-REFERENCE TO RELATED APPLICATIONS

None.

FIELD OF INVENTION

This invention relates, in general, to a method and apparatus for perforating wells, and more particularly to activating a differential pressure firing head at balanced or underbalanced pressures.

BACKGROUND OF INVENTION

Without limiting the scope of the present invention, its background will be described with reference to perforating a hydrocarbon bearing subterranean formation with a shaped-charge perforating apparatus, as an example.

After drilling the section of a subterranean wellbore that traverses a hydrocarbon bearing subterranean formation, individual lengths of metal tubulars are typically secured together to form a casing string that is positioned within the wellbore. This casing string increases the integrity of the wellbore and provides a path through which fluids from the formation may be produced to the surface. Conventionally, the casing string is cemented within the wellbore. To produce fluids into the casing string, hydraulic openings or perforations must be made through the casing string, the cement and a distance into the formation.

Typically, the perforations are created by detonating a series of shaped-charges located within one or more perforating guns that are deployed within the casing string to a position adjacent the desired formation. A firing head assembly is deployed in the work string housing the perforation guns to initiate detonation of the shaped charges. Several techniques have been used to actuate perforating guns, including electrically, through drop-bar mechanisms, and through pressure-actuated mechanisms. A common type of firing head for detonating the perforation guns, is a differential pressure firing head; that is, a firing head which is activated by a pressure differential applied across the firing head.

One commonly used technique for conveying the perforating guns and associated apparatus into the well is to assemble the same on a tubing string, thus providing what is commonly referred to as a tubing conveyed perforating system. Such tubing conveyed perforating systems are available from the Halliburton Reservoir Services division of Halliburton Company, the assignee of the present invention. Perforating guns and associated apparatus can also be deployed on a wireline or coiled tubing.

One commonly used operating system for tubing conveyed perforating systems is a firing head which operates in response to a pressure differential. The pressure differential is typically created by applying increased pressure, either to the tubing string or to the annulus surrounding the tubing string, and conveying the increased pressure to one side (the high pressure side) of an actuating piston contained in the firing head. Typically, such a firing head will have hydrostatic pressure balanced across the actuating piston as the tool is run into the well. When it is desired to operate the tool, increased pressure is applied to the high pressure side of the actuating piston. Some prior art designs have created a pressure differential by increasing tubing pressure, above hydrostatic pressure, on the high pressure side of the piston, where the low pressure reference is hydrostatic pressure. Similarly, some firing head apparatus are actuated by maintaining tubing pressure while reducing hydrostatic pressure, thus creating a pressure differential across the firing head where the hydrostatic pressure is the low pressure. Another approach utilizes an isolated low pressure chamber (often, atmospheric) positioned within or adjacent a firing head as a low pressure reference zone. The firing head actuates in response to increased tubing pressure which creates a pressure differential compared to the low pressure chamber which is in constant communication with the low pressure side of the actuating piston. Other methods employ a low pressure chamber (e.g., atmospheric) positioned in a fluid chamber which is initially open to hydrostatic or tubing pressure. The system is pressure balanced until the low pressure chamber is opened, at which point the fluid pressure in the fluid chamber drops, creating a low pressure reference for firing the head.

Disclosure regarding methods for actuating firing heads and types of differential firing heads can be found in the following references, which are each incorporated herein by reference for all purposes: U.S. Pat. No. 5,301,755, to George; U.S. Pat. No. 4,917,189, to George; U.S. Pat. No. 5,161,616, to Colla; U.S. Pat. No. 4,566,544 to Bagley; U.S. Pat. No. 4,616,718 to Gambertoglio; and U.S. Pat. No. 5,297,718 to Barrington.

There are disadvantages to using firing heads which require substantial pressure to be applied to the tubing or annulus to provide the increase in pressure which actuates the tool. In some instances, the pressures necessary to actuate the tools may be excessively high. Also, in many well perforation jobs it is desirable to perforate in an underbalanced condition, that is with a relatively low pressure present in the well annulus when perforating occurs, and thus if high pressures are applied to actuate the perforating gun, it is necessary to be able to bleed off those high pressures very rapidly before the well is actually perforated. Further, in some situations it is preferable to actuate the perforating guns with no applied tubing or hydrostatic pressure. Thus it is seen that there is a need for a pressure actuated firing system which can avoid or eliminate the application of excessively high pressures.

SUMMARY OF THE INVENTION

A method and apparatus are presented for actuating a differential pressure firing head to actuate a perforating gun at a downhole location in a subterranean wellbore adjacent a formation. An exemplary method includes positioning the perforating gun and the differential pressure firing head at a downhole location on a tubing string and then communicating an applied fluid pressure to a wellbore annulus, a first chamber which communicates the applied fluid pressure to a low-pressure side of the firing head assembly, and a second fluid chamber which communicates the applied fluid pressure to a high-pressure side of the firing head assembly. The applied fluid pressure is then trapped within the second fluid chamber. When the applied pressure in the annulus and first chamber is subsequently decreased, such as by pumping fluid out of the wellbore, a pressure differential is created across the firing head by the low pressure in the first chamber and the trapped high pressure in the second chamber.

The applied fluid pressure can be communicated between the wellbore annulus and the second fluid chamber. The second fluid chamber can have the applied pressure communicated from a third chamber in fluid communication with the wellbore annulus. The pressure can be trapped in the second chamber by a one-way movable element, such as a check valve or one-way floating piston. The second chamber is preferably fluidly isolated and filled with a compressible fluid.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. Upstream and downstream are used to indicate location or direction in relation to the surface, where upstream indicates relative position or movement towards the surface along the wellbore and downstream indicates relative position or movement further away from the surface along the wellbore.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore, however, the inventions disclosed herein can be used in horizontal, vertical or deviated wellbores.

Figure 1:
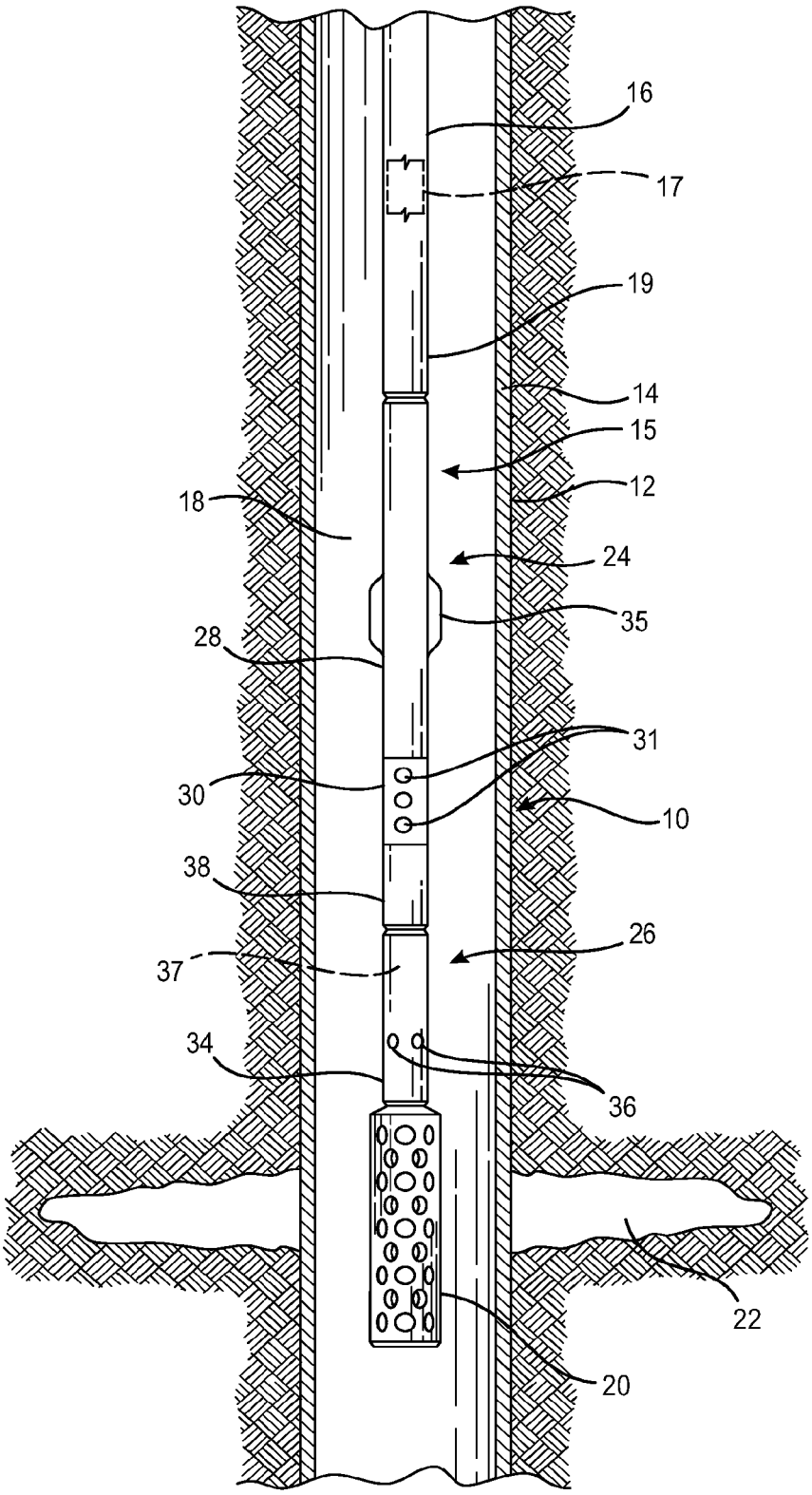
FIG. 1 is a schematic elevational view of an exemplary embodiment according to an aspect of the invention of a perforating assembly, differential firing head assembly and actuator assembly situated inside a wellbore.

Referring now to FIG. 1, therein is schematically depicted one example of a perforating assembly 10 established in accordance with the present invention and situated inside a well 12 in which casing 14 has been set. Perforating assembly 10 is located at the lower end of a tool string 15 which includes tubing string 16. Wellbore annulus 18 is formed between tool string 15 and the casing 14. One or more packers can be utilized with tool string 15 if desired for a particular application. The tool string is shown as a tubing string. It is to be understood that the tool string can incorporate wireline or coiled tubing conveyed tools.

Perforating assembly 10 preferably includes a perforating gun 20, a pressure differential firing head assembly 26, a pump assembly 24, and a novel pressure actuator assembly 38. Perforating gun 20 is preferably located proximate the lower end of perforating assembly 10. In operation, perforating gun 20 is positioned in the well 12 adjacent a formation 22 to be perforated.

Pump assembly 24 is coupled to tubing string 16 and includes pump housing assembly 28. Pump housing assembly 28 includes a ported section 30 which provides fluid communication between tubing string bore 17 (extending through tool string 15) and wellbore annulus 18. Additionally, pump housing assembly 28 supports a pump 35, preferably an electric submersible pump (ESP), in tool string 15. Fluid and fluid pressure are communicated through the pump assembly to the tubing string bore above and below the pump. The pump can be located elsewhere along the tool string or wellbore. Pump assembly 24 facilitates the pumping of fluid from well annulus 18 through ported section 30 into tubing string bore 17. The pump can be positioned at alternative positions and can be any kind of pump (rod pump, etc.), as is known in the industry. The design and operation of pumps is understood by those of skill in the art, samples are explained in the references incorporated herein, and thus, will not be described in detail herein.

Firing head assembly 26 is located within a firing head housing 34. Ports 36 in firing head housing 34 provide fluid communication between well annulus 18 and a chamber 37 inside firing head housing 34. Similarly, the ports 31 of the ported section 30 provide fluid communication between the wellbore annulus and a fluid chamber above the firing head. The ports 31 and ports 36 enable the firing head 26 to be actuated by a pressure differential between the chambers above and below the firing head. As will be described, a fluid chamber in the pressure actuator assembly 38, positioned above the firing head, "traps" a high fluid pressure and communicates that pressure to a high-pressure side of the firing head. The chamber 37 below the firing head communicates a relatively low fluid pressure to a low-pressure side of the firing head when fluid pressure is decreased in the wellbore annulus.

Not shown are the upper wellbore, upper tool string, coupling or connecting subs, etc., as are known in the art. Packers may be used above or below the assembly shown. The packers can be used to isolate an annular portion of the wellbore for operations, act as a hanger for the lower portion of the tool string, etc., as is known in the art. Additional tools usable in the tubing string are not shown. The gun and firing head assemblies can be lowered on a wireline or coiled tubing.

Figure 2:
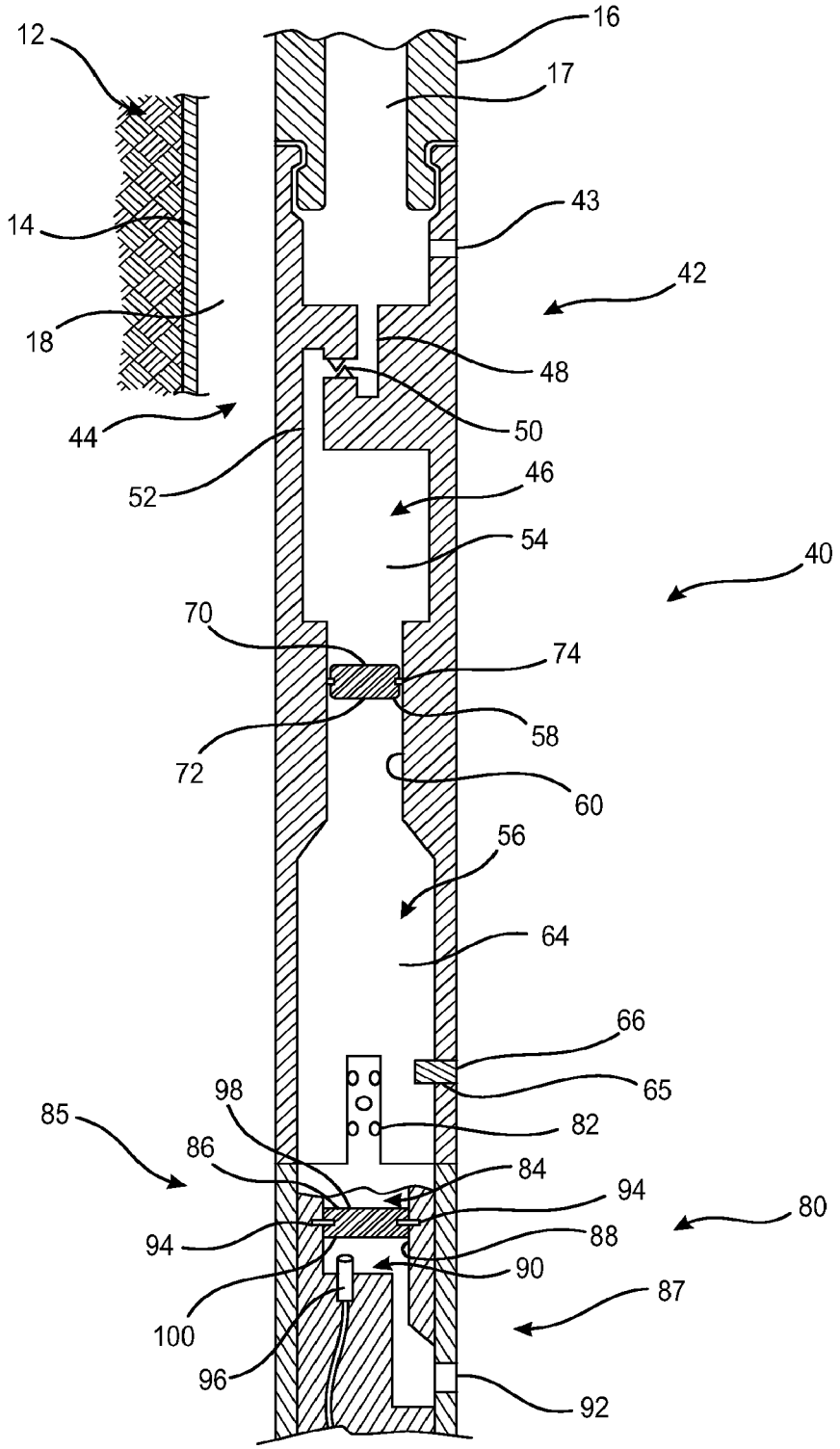
FIG. 2 is a schematic elevational view of an embodiment of an open system differential pressure firing head and actuator assemblies according to an aspect of the invention, seen in a run-in position.

FIG. 2 is a schematic elevational view of an embodiment of an open system differential pressure firing head and actuator assemblies according to an aspect of the invention, seen in a run-in position. A portion of tubing string 16 having a bore 17 defined therein is seen attached to an exemplary differential pressure actuator assembly 40 or "pressure trap"

assembly. Attached below the pressure trap assembly 40 is a differential firing head assembly 80.

The pressure trap assembly 40 defines an upper fluid passageway assembly 42 which communicates fluid (and fluid pressure) from the tubing bore 17 through a bleeder port assembly 44 to an upper fluid chamber 46. Alternately, fluid can be communicated from the annulus 18 through a port 43, as shown. The bleeder port assembly 44 provides fluid communication from an upper passageway 48, through a bleeder port 50 and to lower passageway 52. The bleeder port assembly 44 preferably provides for a controlled flow of fluid therethrough, with a preselected maximum flow rate. Bleeder or bleed ports and valves are known in the art and will not be described in detail herein. The bleeder port assembly can alternately be other fluid communication ports and passageways, as are known in the art. The bleeder port assembly allows for fluid to flow from the tubing string bore 17 into the upper fluid chamber 46.

Upper fluid chamber 46 is preferably filled with an incompressible fluid 54, such as oil or other liquid, prior to run-in of the tool. The upper chamber 46 communicates fluid pressure to a lower chamber 56 by way of a movable element 58 positioned between the chambers. Note that fluid is not communicated from the upper chamber 46 to the lower chamber 56 in the preferred embodiment shown.

The movable element 58 is preferably a floating piston, wiper plug, check valve, annular piston, sliding sleeve, etc., and is shown schematically as a piston element. Alternate movable elements and assemblies will be apparent to those of skill in the art. In a preferred embodiment, the movable element 58 moves in only one direction, namely, downward in the embodiment shown. Reverse (upward) motion is prevented or limited by means known in the art, such as snap ring and groove, expansion ring and groove, snap collar, one-way ratchet, collet assembly, etc. An exemplary schematic locking element 79 is shown. The movable element 58 slides within a bore 60 defined between the upper and lower chambers. In a preferred embodiment, fluid does not pass through the movable element. That is, fluid on the upper side of the element is isolated from, and not in fluid communication with, fluid on the lower side of the element. Seals 74 can be used to isolate the fluids. The movable element 58 has an upper face 70 upon which fluid pressure acts from above (from upper chamber 54) and a lower face 72 upon which fluid pressure acts from below (from lower chamber 56). Movement of the element is limited by appropriate means, such as shoulders 76 and 78 shown.

The lower chamber 62 is filled with a compressible fluid 64. Such fluid can be placed into the lower chamber 62 prior to run-in, for example, through a fill port 64 which is then plugged, such as with a Kolb plug 66. The compressible fluid is preferably air or another gaseous substance. In a preferred embodiment, the compressible fluid is at atmospheric pressure for ease of assembly and handling.

The lower chamber 62 is in fluid communication with a high-pressure side 85 of the differential pressure firing head assembly 80. More specifically, the compressible fluid in the lower chamber 62 is free to flow through firing head ports 82 into a high-pressure chamber 84 of the firing head.

The differential firing head assembly 80 will not be described in detail since such assemblies are known in the art. A movable firing head element 86 is schematically shown as a piston element positioned to slide in a piston bore 88. The firing head movable element defines an upper face 98 and a lower face 100 upon which fluid pressure acts to move the element along bore 88. Although a cylindrical piston is shown for ease of reference, an annular piston, sliding sleeve or other element can be employed.

On opposite sides of the firing head movable element 86 are a high pressure chamber 84 and a low pressure chamber 90. The low-pressure chamber 90 is in fluid communication, by way of a firing head assembly port 92, to the wellbore annulus 18. The movable element 86 is maintained in an initial position (prevented from moving downward) by a resisting feature 94, preferably a shear mechanism, such as the shear pins shown. Alternate resisting features, such as shear mechanisms, shear rings, shear collars, snap rings, snap collars, etc., are known in the art. The movable element is free to move downward upon shearing of the shear pins. The shear pins shear at a pre-selected differential pressure across the movable element, and thus, at a differential pressure from the lower chamber 56 and the wellbore annulus 18. The movable element is a one-way element; that is, the element does not move upwardly, even where a pressure differential exists that would tend to move the element upwardly. For example, a suitable shoulder (not shown) or other stopping element can be employed as known in the art.

The movable element 86, once the resisting feature is sheared, moves downward and actuates a firing pin 96 or otherwise actuates the firing head assembly. The firing pin, in turn, actuates the perforating gun assembly by means known in the art. The perforating gun assembly fires shaped charges (typically), thereby perforating the casing and any cement, and into the formation. Production fluid from the formation can then be produced from the formation, through the perforations in the casing and into the wellbore annulus. From there, the formation fluid is flowed to the surface. In a preferred embodiment, the formation fluid is pumped using the ESP 35 in the tubing string.

Figure 3:
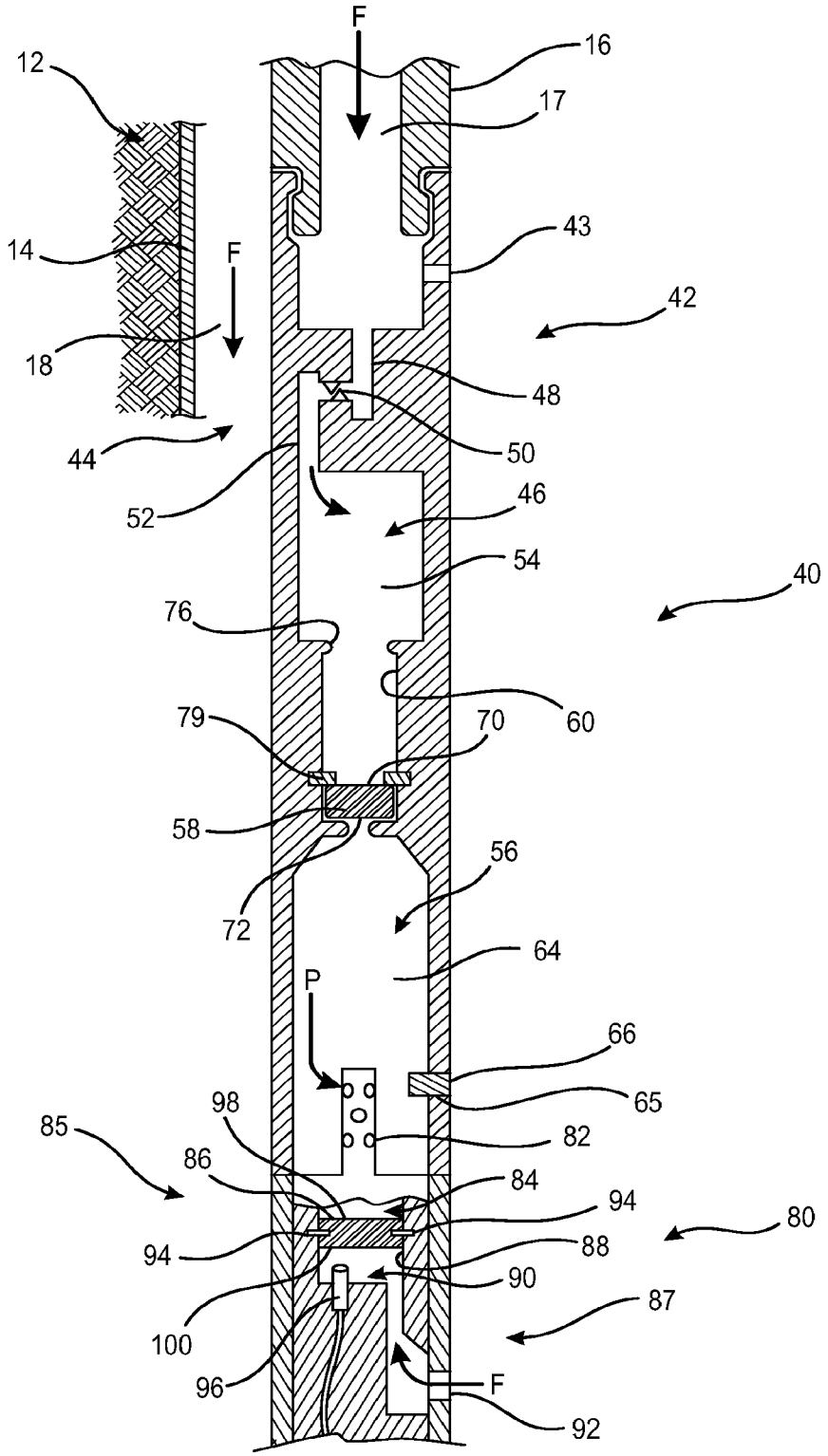
FIG. 3 is a schematic elevational view of an embodiment of the differential pressure firing head and actuator assemblies seen in FIG. 2 with applied fluid pressure and a movable element in an intermediate position, in accordance with the present invention.

FIG. 3 is a schematic elevational view of an embodiment of the differential pressure firing head and actuator assemblies seen in an intermediate position wherein fluid pressure has been applied in the wellbore annulus and tubing bore. The applied fluid pressure can be pumped down through the tubing bore and/or through the wellbore annulus, as indicated by the arrows F. The applied fluid pressure can be greater than the formation pressure. The perforation assembly, firing head assembly, pressure trap assembly, and optional pump assembly are run-in to the wellbore to a selected location. To prevent early or unplanned firing of the firing head, fluid pressure is balanced across the firing head movable element 86. That is, the fluid pressure in firing head chambers 84 and 90 are balanced such that there is insufficient differential pressure across the element 86 to shear the pins 94.

More generally, pressure is balanced between the wellbore annulus 18 and the tubing bore. Changes in fluid pressure in the wellbore annulus are communicated to the low pressure side 87 of the firing head 80 in chamber 90 through port 92. Fluid, F, is free to flow, in the preferred embodiment, from the annulus 18, through port 92 and into the low pressure chamber 90. Fluid pressure changes in the tubing bore 17 are communicated through the bleed port assembly 44 to upper chamber 46 and to the upper surface 70 of the movable element 58. In turn, the movable element 58 moves in response to a pressure differential across the element 58. Since the lower chamber 56 is initially at atmospheric (or other selected low) pressure, a differential pressure is applied across the element 58. The element moves downward, to the position seen in FIG. 3, thereby communicating the fluid pressure, P, to compress the fluid in lower chamber 56 until pressure is equalized across the element 58 or until the element has moved its maximum stroke. Reverse movement of the element 58 is prevented by actuation of a locking element 79.

At this point in the method, the applied fluid pressure has been "trapped" in the lower chamber 56. As explained above, the applied pressure can be provided by increasing pressure by suitable means and communicating it downhole via the tubing bore and/or wellbore annulus. The fluid pressure between the wellbore annulus and tubing bore is balanced (both at the applied pressure), by fluid communication between them, such as through port 43 or other fluid path. The applied fluid pressure is also communicated to the upper chamber 46 by port assembly 44. In turn, the applied fluid pressure is communicated to the lower chamber 56 by movement of the piston element 58 downward. Since the piston element is a one-way piston (or similar), the applied fluid pressure is trapped in the lower chamber. The lower chamber is in fluid communication with the high-pressure chamber 84 of the firing head assembly. Consequently, the same high applied pressure is present in the wellbore annulus, the tubing bore, the upper and lower chambers 46 and 56 of the actuating assembly 40, and the high and low pressure chambers 84 and 90 of the firing head assembly.

Note that it is possible that the applied pressure in the wellbore or tubing is greater than that in the lower chamber 56. For example, where the applied pressure is high enough to not only move the element 58 to its lowest position, but also to continue applying pressure to the element, then the applied pressure outside of chamber 56 will be higher than the trapped applied pressure in the chamber 56. This is not a problem since a pressure differential across the firing head from the low pressure side 87 to the high pressure side 85 will not actuate the firing head element 86.

Figure 4:
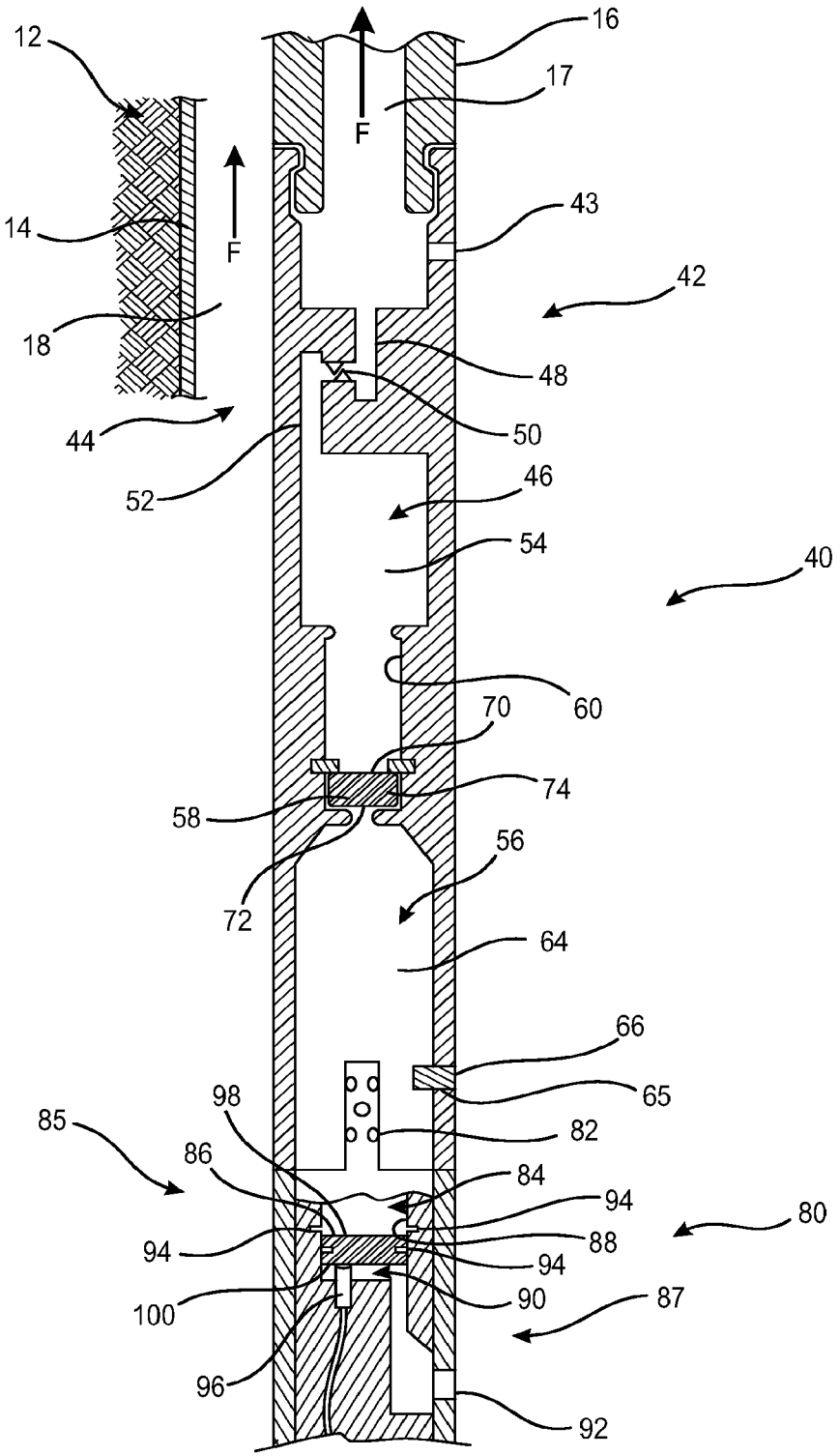
FIG. 4 is a schematic elevational view of the assemblies of FIG. 2, wherein the applied pressure in the wellbore annulus and/or tubing bore has been decreased or removed, and wherein the firing head assembly has been actuated, in accordance with the present invention.

FIG. 4 is a schematic elevational view of the assemblies of FIG. 2, wherein the applied pressure in the wellbore annulus and/or tubing bore has been decreased or removed, and wherein the firing head assembly has been actuated. In some situations it is preferable to actuate a firing head and perforating gun with no applied pressure in the tubing bore or wellbore annulus. For example, this procedure may be desired in a underbalanced perforation. At a selected time, the applied pressure is decreased or removed, such as pumping fluid, F, upward through the wellbore annulus and/or tubing bore. The pumping can be accomplished by the ESP 35 or by other methods known in the art.

As the applied pressure is dropped, the pressure in the wellbore annulus, tubing bore, upper chamber 46 of the actuating assembly 40, and low-pressure chamber 90 of the firing head assembly similarly drops to a relatively low pressure. This pressure is reduced below that of the trapped applied pressure still present in the lower chamber 56 of the actuating assembly 40 and in the high-pressure chamber 84 of the firing head assembly 80. Consequently, a differential pressure is exerted across the firing head piston 86. When the differential pressure reaches a predetermined amount, the shear pins 94 shear and the piston 86 moves in response to the differential pressure. The piston element 86 moves downwardly into contact with the firing pin 96, which in turn actuates the perforating gun by methods known in the art.

The relatively high-pressure in lower chamber 56 can be released after actuation of the perforating gun. For example, the pressure can be relieved at the time of detonation, before or after retrieval of the assembly, etc.

As used herein, "fluid communication" (and similar) refers to the ability for fluid to flow or pass from one space to another space (e.g., wellbore annulus, tubing bore, fluid chambers, passageways, etc.) either directly or through intervening spaces, such as passageways. Such fluid communication, obviously, also communicates fluid pressure. That is, fluid under a relatively higher pressure will flow into connected spaces of relatively lower pressure until the pressure is equalized between the spaces.

In contrast, "fluid pressure communication" (and similar), as used herein, refers to communication of pressure from one space to another. The pressure is conveyed by application of fluid (liquid, gas, a combination), but pressure communication does not require transfer of the fluid itself from one space to another. For example, fluid pressure is communicated from upper chamber 46 to lower chamber 56 and the high-pressure side 85 of the firing head element 86, but the fluid in the chambers 56 and 84 are isolated from the fluid in the upper chamber 46.

Figure 5A:
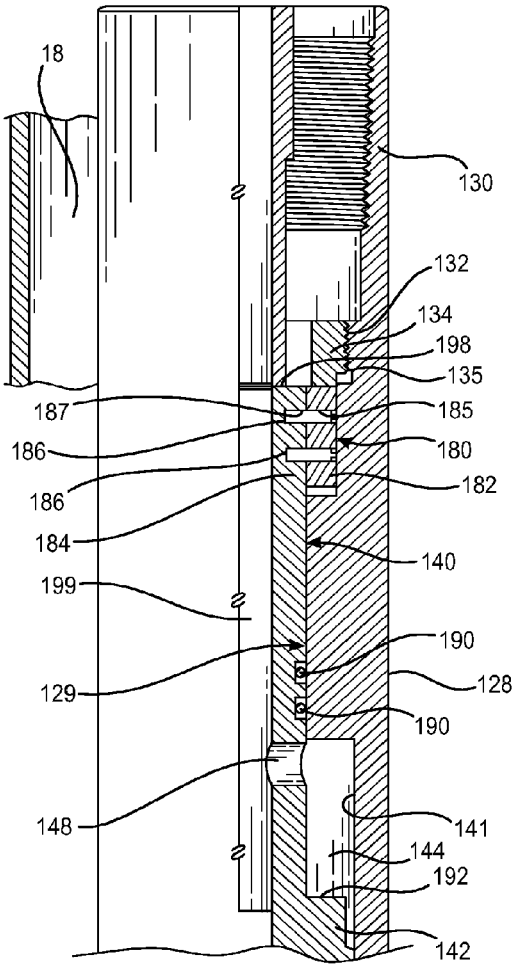
FIGS. 5A-B are elevational views in partial cross-section of an exemplary embodiment of a firing head in accordance with the present invention.
Figure 5B:
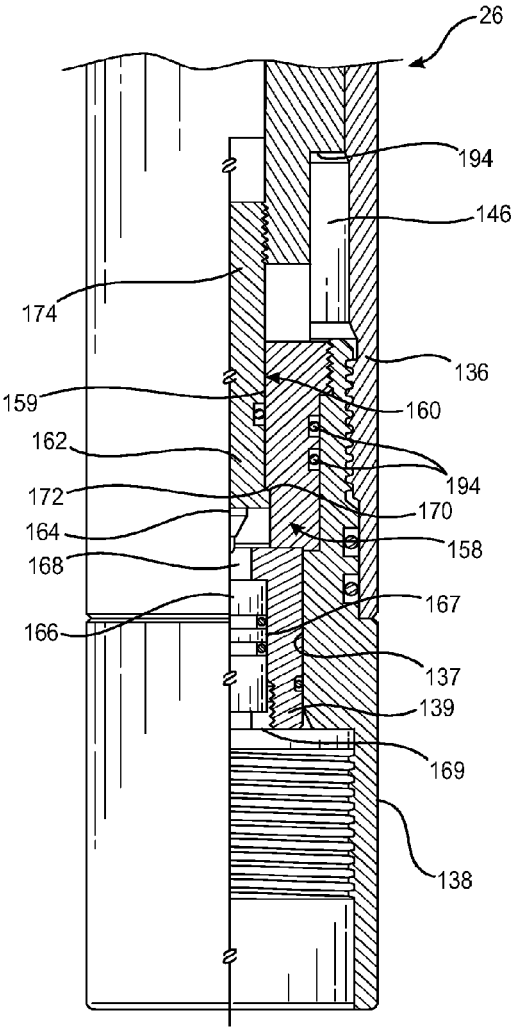

FIGS. 5A-B are elevational views in partial cross-section of an exemplary embodiment of a firing head in accordance with the present invention. Firing head 26 is actuated by differential pressure between the wellbore annulus 18 and the lower chamber 56 (the applied pressure trapping chamber) of the actuating assembly 40. Firing head 26 includes an upper firing head housing 128 adapted to be attached at its upper end 130 to the actuating assembly 40. Upper firing head housing 128 is threadably coupled to lower firing head housing 138, which is, in turn, adapted to be coupled to a perforating gun in a conventional manner. The upper firing head housing 128 includes interior threads 132 adapted to engage a retainer ring 134, as discussed below. The lower end 136 of the upper firing head housing 128 is threaded onto a lower firing head housing 138.

A firing head mandrel 140 is slidably and sealingly received in upper firing head housing 128. Firing head mandrel 140 preferably sealingly engages an inner projection 129 within upper firing head housing 128. Additionally, a projection 142 extends from the body of firing head mandrel 140 and slidingly and sealingly engages an interior surface 141 of upper firing head housing 128. Projection 142 on firing head mandrel 140 and projection 129 on firing head housing 128 cooperatively define an upper annular chamber 144. Radial ports 148 in upper firing head housing 128 provide fluid communication between the upper annular chamber 144 and the pressure trapping, lower chamber 56, such as through internal passageway 199. Shoulder 198 projects over the upper end of the mandrel 140 to insure no upward movement of the mandrel during run-in or operation.

Projection 142 on firing head mandrel 140, upper firing head housing 128, lower firing head housing 138 and piston retainer 158 cooperatively define a lower annular chamber 146. Radial ports 150 in the firing head mandrel 140 provide fluid communication between the wellbore annulus 18 and lower annular chamber 146. The described configuration allows firing head mandrel 140 to function as an downwardly movable piston responsive to a pressure differential between the lower chamber 56 (communicated to upper annular chamber 144) and the wellbore annulus 18 (communicated to lower annular chamber 146).

Piston retainer 158 includes a bore 159, in which a firing piston 160 is slidingly and sealingly received. Lower firing head housing 138 includes a bore 137 in which an initiator block 139 is sealingly received. Initiator block 139 receives an initiator charge 166 in an internal bore 167. Initiator 166 is sealingly received within initiator block 139 and is preferably retained in place by any suitable mechanism, for example, retaining ring 169. Because of the described sealing engagements, a chamber 168 is formed between initiator 166 and firing piston 160 which will be at atmospheric pressure.

Firing piston 160 includes a firing pin 164 at its lower end. Firing pin 164 is adapted to be driven into initiator 166, thereby causing an explosion which will detonate a perforating gun, resulting in perforation of the well in a conventional manner. Firing piston 160 has a radial projection 170 proximate its lower end 162. The projection 170 cooperates with a radial recess 172 in piston retainer 158 to limit upward movement of firing piston 160 after initiator 166 is detonated. Firing piston 160 is attached to the firing head mandrel 140 at threads 174.

Firing head mandrel 140 is retained in the fully upward, unactuated position, as depicted in FIG. 5, by means of a shear pin assembly, indicated generally at 180. Shear pin assembly 180 includes an outer shear block 182 and an inner shear block 184, with inner shear block 184 shown as of a piece with mandrel 140. Shear pins 186 engage apertures 185, 187 in outer shear block 182 and inner shear block 184, respectively. Outer shear block 182 is retained in position in upper firing head housing 128 by a retainer ring 134 which is threaded at 135 to upper firing head housing 128. Shear pins 186 therefore retain firing head mandrel in a first, unactuated, position. The strength of shear pins 186 will be determined by the amount of pressure differential that is desired to be required to actuate the firing head assembly 26.

The operation of the firing head assembly 26 is as follows. At the beginning of the perforating operation, upper annular chamber 144 is in fluid communication with the lower chamber 56 through ports 148 and passageway 199, and fluid pressure in upper annular chamber 144 is therefore equal to the fluid pressure in the lower chamber 56. Lower annular chamber 146 is in fluid communication with the wellbore annulus 18 through the ports 150. Because the pressure of the fluid in the wellbore annulus, and therefore in lower annular chamber 146, will be equal to the pressure of the fluid in the tubing string, and therefore in upper annular chamber 144, the firing head mandrel will be pressure balanced and retained in its first, unactuated, position by shear pin assembly 180.

When fluid pressure is applied, such as by pumping fluid into the tubing string or wellbore annulus, the fluid pressure in wellbore annulus 18 and tubing bore exceeds the atmospheric (or other low) fluid pressure in the lower chamber 56. The relatively higher applied pressure is communicated through the bleed port assembly 44 to the upper fluid chamber 46. In turn, the applied pressure in the upper chamber 46 is communicated to the lower chamber 56 by actuation of movable element 58 in response to the differential pressure. The pressure in the lower chamber 56 is now the applied fluid pressure, which is communicated through ports 82 and passageway 199 to the upper annular chamber 144.

When the applied fluid pressure is reduced or removed, such as by pumping fluid uphole from the wellbore annulus 18 and tubing string bore, the pressure across firing head mandrel 140 becomes unbalanced and urges firing head mandrel 140 in a downward direction. The applied pressure trapped in the lower chamber by one-way piston element 58 becomes the high-pressure reference for the firing head assembly. The reduced pressure in the wellbore annulus is communicated to the lower annular chamber 146 and becomes the reference low-pressure for the firing head assembly. The differential pressure favors downward movement of the mandrel 140. When the force from the differential pressure across the firing head mandrel 140 exceeds the established shear strength of shear pins 186, the pins shear and firing head mandrel 140 moves downwardly. Firing piston 160 is forced downward by the mandrel. Firing pin 164 contacts initiator 166 and initiates the perforating gun detonation in a conventional manner.

In a preferred method of practicing the invention, the pump 35 may later be utilized to produce the well. The pump 35 may also be used to apply the fluid pressure which becomes trapped in the lower chamber 56 of the actuating assembly 40. Similarly, the pump 35 may be used to reduce or remove the applied pressure, thereby establishing the pressure differential across the firing head assembly to actuate firing head 26. The trapped pressure in the lower chamber 56 can be released after movement of the firing head piston, either prior to or after retrieval.

The shear pins 186 can be designed to withstand selected pressure differentials between the fluids in upper annulus 144 and lower annulus 146. For example, shear pins 186 can be selected to withstand the force equal to the applied pressure established in the wellbore annulus 18. In such a case, shear pins 186 will shear when the fluid pressure in the wellbore annulus 18 has been decreased to below the applied pressure. Those of skill in the art will recognize that the system can actuate the firing head in an underbalanced condition.

In a preferred method of practicing the invention, the pump which will later be utilized to produce the well will also be utilized to establish the pressure differential in favor of the tubing string to actuate firing head 26. Pump 74 will be actuated to pump fluid from wellbore annulus 18, through ports 96, 97, and into tubing string bore 17, thereby decreasing the hydrostatic pressure of the fluid in wellbore annulus 18. When the fluid level in the annulus has been pumped down sufficiently to establish this actuation differential, shear pins 186 will shear and firing head 26 will operate as described above.

The shear pins 186 can be designed to withstand various pressure differentials between the fluids in upper annulus 144 and lower annulus 146. For example, shear pins 186 can be selected to withstand the force equal to the pressure of the entire fluid column in the wellbore annulus 18 above the pump assembly. In such a case, shear pins 186 will shear when the fluid in the wellbore annulus 18 has been lowered to the depth of ports 96,97. In this manner, a maximum pressure underbalance between the wellbore annulus 18 and the formation will be achieved before the perforation. Additionally, firing head 26 may be actuated by shutting-in the tubing string at the surface, actuating the pump, and allowing the pump to thereby increase the pressure in the shut-in tubing to achieve the actuation pressure of firing head 26. Firing head 26 can also be actuated by pressuring down the tubing string from the surface.

The perforator gun assembly, detonators, shaped-charges, etc., are known in the art and will not be described in detail herein. Further information about shaped-charges, perforation assemblies, etc., can be found in the following references which are hereby incorporated in their entirety for all purposes: U.S. Pat. No. 3,589,453 to Venghiattis, U.S. Pat. No. 4,185,702 to Bullard, U.S. Pat. No. 5,449,039 to Hartley, U.S. Pat. No. 6,557,636 to Cernocky, U.S. Pat. No. 6,675,893 to Lund, U.S. Pat. No. 7,195,066 to Sukup, U.S. Pat. No. 7,360,587 to Walker, U.S. Pat. No. 7,753,121 to Whitsitt, and U.S. Pat. No. 7,997,353 to Ochoa; and U.S. Patent Application Publication Nos. 2007/0256826 to Cecarelli, 2010/0300750 to Hales, and 2010/0276136 to Evans. Various arrangements of shaped-charges may be employed. Similarly, the shaped-charges in FIG. 3 are shown as extending radially across most of the diameter of the charge holder, but other size and configuration of charges may be used.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. A method of actuating a differential pressure firing head to actuate a perforating gun at a downhole location in a subterranean wellbore adjacent a formation, the method comprising:

positioning the perforating gun and the differential pressure firing head at a downhole location on a tubing string;

communicating an applied fluid pressure to a wellbore annulus, a first chamber, and a sealed second fluid chamber, wherein the wellbore annulus is defined between the perforating gun and firing head and the wellbore, wherein the first chamber communicates the applied fluid pressure to a low-pressure side of the firing head, and wherein the sealed second fluid chamber communicates the applied fluid pressure to a high-pressure side of the firing head;

trapping the applied fluid pressure within the second fluid chamber; and decreasing the applied pressure in the first chamber and the wellbore annulus, thereby creating a differential pressure across the firing head sufficient to actuate the firing head.

2. The method of claim 1, wherein communicating an applied fluid pressure further comprises pumping fluid down the wellbore annulus.

3. The method of claim 1, wherein communicating an applied fluid pressure further comprises pumping fluid down a bore defined in the tubing string.

4. The method of claim 3, further comprising communicating the applied fluid pressure between the tubing bore and the wellbore annulus.

5. The method of claim 4, further comprising communicating the applied fluid pressure between the wellbore annulus and the second fluid chamber.

6. The method of claim 1, wherein communicating an applied pressure to the sealed second fluid chamber further comprises compressing a compressible fluid in the second fluid chamber.

7. The method of claim 6, further comprising communicating the applied fluid pressure to a first side of a movable pressure-actuated element, thereby moving the pressure-actuated element and compressing the compressible fluid further.

8. The method of claim 7, wherein trapping the applied fluid pressure in the second fluid chamber further comprises moving a pressure-actuated element which is a one-way piston or a check-valve.

9. The method of claim 7, wherein moving the pressure-actuated element further comprises communicating the applied fluid pressure to an incompressible fluid chamber on the opposite side of the pressure-actuated element.

10. The method of claim 9, further comprising communicating the applied fluid pressure to a third fluid chamber separated from the second fluid chamber by the pressure-actuated element.

11. The method of claim 10, wherein the third fluid chamber is in fluid communication with either the tubing bore or the wellbore annulus.

12. The method of claim 11, further comprising flowing fluid from either the tubing bore or the wellbore annulus through a bleed port into the third chamber.

13. The method of claim 12, wherein the third chamber is filled with incompressible fluid.

14. The method of claim 7, wherein the compressible fluid in the second chamber is isolated from the fluid on the first side of the pressure-actuated element.

15. The method of claim 6, wherein the compressible fluid in the second chamber is isolated from the fluid in the wellbore annulus.

16. The method of claim 1, wherein decreasing the applied pressure in the first chamber and the wellbore annulus further comprises pumping fluid uphole from the wellbore annulus or tubing bore.

17. The method of claim 16, further comprising pumping fluid utilizing an electric submersible pump positioned in the tubing string.

18. The method of claim 1, wherein decreasing the applied pressure in the first chamber and the wellbore annulus further includes decreasing the applied pressure to less than the formation pressure.

19. The method of claim 1, further comprising actuating the differential pressure firing head and firing the perforating gun.

20. The method of claim 19, further comprising producing hydrocarbons from the formation.

* * * * *